thrust losses, not only for changes in a direction closer to the wind, but also changes in which the vessel is directed more away from the wind. Other problems with the sloop rig such as excessive healing force in relation to forward drive, difficulties in adjusting the rig to operate in different wind velocities, difficulties in rearranging to accommodate roller furling or reefing and self-tacking devices are well known, and many others well known in the art are described by Marchaj, supra.

It has now been found that it is possible to sail efficiently to windward at closer angles with less relative power loss for a given sail area than has been previously possible, and achieve many other significant advantages over previous sailing vessels, by utilizing the particular sailing rig of the present invention. As depicted in FIG. 3, the sailing vessel embodying the invention comprises a hull 51 with a plurality of masts 52 and 53, each bearing a jib numbered 54 and 55 respectively. Jib 54 is attached at its clew 56 to sheet 58, which then runs through its fairlead 60 to well known suitable means for adjusting and fixing the sheet (not shown). Similarly, jib 55 is attached at its clew 57 to sheet 59, which is run through its fairhead 61 to suitable adjustment means.

A striking difference can be observed in comparing the jib of FIG. 2 with the jibs of FIG. 4. Both jibs in FIG. 4 have a camber as measured horizontally at the clew of the jib of greater than 12%, e.g., a camber of between about 12% and 25%, preferably between about 14 and 20%, most preferably between 14.5 and 18%. As depicted in FIG. 4, both jibs have a camber of about 16%. Above this point the cambers generally increase within the above ranges to a maximum near the middle of the sail, and then decrease to essentially no camber at the very top of the sail.

As shown in FIGS. 3 and 4, the most preferred embodiment employs only sails which are not encumbered by a mast along their leading edge. However, if at least two sails are thus unencumbered, further sails akin to normal mains, i.e., attached to a mast along their luff, can also be employed. Preferably, the sheeting angle is set for both jibs so that the extension of the jib sheet intersects the luff at above more than 50% of its length, preferably from 60 to 90% of its height, more preferably from about 65–80% of its length.

The placement of the jib fairleads in relation to the centerline of the boat varies from that previously experienced with the sloop rig. As pointed out by Marchaj, supra, at 161–62, the fairlead setting in a normal sloop rig for "closehauled" sailing (e.g., sailing at an angle as close to the wind as practical), should be such that the "angle of trim" (the angle defined by a line from the clew of the jib to its tack on the one hand and by the centerline of the vessel on the other) is at least about 17°. The angle of trim is not nearly as crucial in the plural jib rig of the present invention, and can vary greatly depending on the size and shape of the sails and the characteristics of the vessel. With the rig of the present invention, the angle of trim can be from about 0° to 25° or more, preferably from about 8° to about 22°, most preferably from about 10° to 16°. The closer together the jibs are placed, the more likelihood that forward jib may have an adverse effect on the wind which drives the sail(s) further aft. In some instances, particularly in motor sailing, it may be preferable to use low angles of trim to get closer into the wind, even though there is some loss of sail efficiency because the overall efficiency of the vessel will still be greater, which will be reflected in reduced fuel consumption. At any rate, the optimum angle of trim will generally be less than those utilized on normal sloop rigs, at least partially because of the differences in the slot between the plural jibs of the present invention, and the slot between the jib and the main in the normal sloop rig.

An experienced sailor would be quite surprised that the jib settings shown in FIG. 4 represent the settings for sailing at a close angle into the wind. However, it has surprisingly been found that the sailing rig depicted in FIGS. 3 and 4 can not only be sailed at close angles into the wind, but can actually be sailed at closer angles to the wind with less relative power loss for a given sail area than sail rigs such as that depicted in FIGS. 1 and 2. The rig depicted in FIGS. 3 and 4 can be sailed as close to the apparent wind as 25° without apparent loss of power, and as close as 10° to the apparent wind under motor sailing without loss of the shape of the sails. This ability to hold its shape at extremely low angles is an additional benefit, since the luffing, which both increases the sail drag and has an adverse effect on the life of the sails, is not produced. At the same time, while the set of sails shown in FIGS. 3 and 4 is for sailing at close angles to the wind, the same sail setting is useful without substantial loss of power at larger angles to the wind, again without as substantial a relative power loss for a given sail area as if a sail plan such as depicted in FIGS. 1 and 2 were at angles to the wind greater than the optimum angles for that setting of those sails.

These same advantages were not achieved by previous multiple-jib craft, such as the 128 foot, triple jib Vrendredi 13, designed by the present inventor for the single-handed Atlantic crossing race which it participated in in 1972. See *Life*, Vol. 68, pp. 86–92, (1972), also hereby incorporated by reference. That vessel had three large jibs in fore-and-aft relationship, but rigged and sheeted in a similar manner to the standard methods of handling jibs on sloop rigs. Those jibs were flat in camber, and were sheeted in a much different way than those of the present invention. Those jibs were not merely sheeted at the clew, but rather were attached to a straight boom at various points all along the foot, and the foot of each sail was rendered taut along that boom by an outhaul attached to the clew. As a result, the foot of each of those sails was of extremely low camber.

Preferably the masts and the jibs are of approximately the same size, but either of the masts can be larger than the other. The jibs also can be different in size and/or shape, whether or not the masts are the same size. The two masts can be attached to each other by a compression member 62, which obviates the need for a backstay, thus allowing the rear mast to be placed closer to the transom of the vessel.

The rig of the present invention is particularly advantageous in medium to strong winds, and preferably at least one and more preferably all of the jibs are equipped with roller furling apparatus, which itself is well known and readily available in the art, and which is shown systematically at 63 and 64 on FIGS. 3 and 4. The use of roller furling in combination with the rig of the present invention magnifies the basic stability of the present system to such an extent that almost any wind situation can be handled comfortably with a minimum of effort. If heavy weather comes up, the aft jib can be partially furled to the point where the vessel handles the wind comfortably. If the strength of the wind increases even more, the aft jib can be furled even more and forward jib(s) can be furled, so that the vessel can re-

SAILBOAT TRIMMING AND STABILIZING SYSTEM

This application is a continuation-in-part of Ser. No. 12,755 filed Feb. 16, 1979, now abandoned.

BACKGROUND OF THE INVENTION

1. Field of the Invention

The field of the invention has to do with the rigging of sailboats and with means for controlling the trim or leveling of sailboats, such as for example, sailboats equipped with a sloop rig or other types of rig. The invention is adapted to use with multiple hull craft as well.

2. Description of the Prior Art

The herein inventor is the Patentee in U.S. Pat. No. 3,985,106 which is considered to represent the presently known prior art.

In the operation of sailboats, especially small boats equipped with particular rigs, such as for example a sloop rig, the hull heels over as the wind exerts force on the sails. This tends to detract from the comfort of those occupying the boat, particularly more inexperienced sailors. The aforesaid prior patent teaches means whereby the hull can be maintained in a more level or trimmed condition by the use of a mast which can tilt to port or starboard and in so doing it shifts weights to positions to restore the mast to its upright position and to maintain the hull in a more level attitude. The herein invention seeks to provide further improvements calculated to enhance this purpose and result.

The boat tends to move leeward at any time it is under way using wind power. The prior art lacks teaching of means for the purpose of offsetting this tendency, the herein invention being calculated to meet the problem.

In a system wherein the mast can tilt to port or starboard this, of course, changes the position and attitude of the sails, that is, the aspect of the sails, such as a foresail and mainsail relative to the wind. The prior art lacks teaching of means to meet this problem, that is, to maintain the sails in a more normal attitude when associated with a mast which can tilt. The herein invention seeks to provide means effective for the purpose of solving this problem.

SUMMARY OF THE INVENTION

The basic nature of the invention is summarized in the abstract.

In the preferred exemplary form of the invention as described in detail herein, the mast is pivotally mounted so that it can tilt to port or starboard relative to the hull. The mast is connected to a means which in a preferred form of the invention is an amidships torsion bar aligned with the center line of the craft, so that when the mast tilts a force is applied to restore the mast position and to contribute to stability of the craft by minimizing heeling.

The torsion bar transmits a portion of the effort to the opposing windward side of the hull.

In a preferred form of the invention, the mast has a pivotal mounting so that it can tilt to port or starboard. The lower end of the mast cooperates with a yoke which is connected to the torsion bar to apply tension within the bar. The opposite end of the bar is connected to the hull of the boat, thus when torsion is applied to the bar, that is, twisting effort, the torsion bar applies a righting moment to the hull.

In a typical sailing rig such as a sloop rig, having a foresail and mainsail associated with the tilting mast, of course, when the mast tilts it tends to change the position or attitude of the sails tending to cause them to spill the wind rendering them less effective. In the preferred form of the invention, an auxiliary mast is provided which is suspended like a pendulum from the mainmast so that it can be swung from port to starboard.

The auxiliary (secondary) mast is moved by the yoke which is attached to the forward end of the torsion bar, which is moved by the mainmast. The auxiliary mast is moved through cables and a slotted attachment attached to the mainmast.

A jib boom is provided for the foresail with means in the form of sheets manipulatable by the helmsman to adjust the forward end of the jib boom so that when the mast tilts, the foresail as well can be adjusted to a more effective position in which it is aligned with the mainsail.

Further, an adjustable, that is, rotatable keel is provided which is connected to the regular mast (through the yoke) so that when the mast tilts, the keel is adjusted to offset the tendency of the hull to make headway or to drift to leeward while in motion.

In the light of the foregoing, the primary object of the invention is to make it possible to equip a sailboat with means operable to stabilize the boat and to reduce heeling of the hull.

A further object is to provide means to realize the foregoing, wherein the mast is mounted to be able to tilt to port or starboard and is connected to means preferably in the form of a torsion bar whereby to provide a force when the mast tilts tending to restore the mast to its upright position and to drive the hull down to windward.

Alternative means provided for producing the restoring force to the mast and the righting moment to the hull. These alternative means are adaptable for use with craft of the type described above but also with craft of the multiple hull type, such as catamarans, etc.

In one of these alternative forms of the invention the mast actuates a yoke as described in the foregoing. The yoke carries flexible members extending to port and starboard and engagable with the sides of the hull and this may simply be the gunwales. When the yoke tilts to port or starboard, one or the other of the flexible elements is flexed, that is, bent so that a force is produced tending to return the mast to upright position and to provide a righting moment to the hull.

In another form of the invention the yoke is provided with extending rigid members which extend to port and starboard. Flexible members, preferably in the form of bowed, springs are provided attached to the hull. When the mast tilts, one or the other of the rigid members engages one of the springs flexing it and producing tension in it which produces the force for returning the mast to upright position and producing a righting moment on the hull, that is, on the windward side.

A further object is to make it possible to adjust sails associated with a mast which tilts so that the sails can be maintained in a more normal and effective position when the mast tilts.

A further object is to realize means for maintaining effectiveness of a jib sail by way of an adjustable jib boom whereby the foresail can be moved or adjusted to a more effective aspect when the regular mast tilts.

A further object is to realize means for offsetting the tendency of a sailboat to make headway to leeward.

A further object is to realize means for realizing the foregoing by way of an adjustable or rotatable keel which is connected by cables to the tilting mast so that when the mast tilts, the keel is adjusted to offset the tendency of the hull to make headway to leeward.

Figure 1:
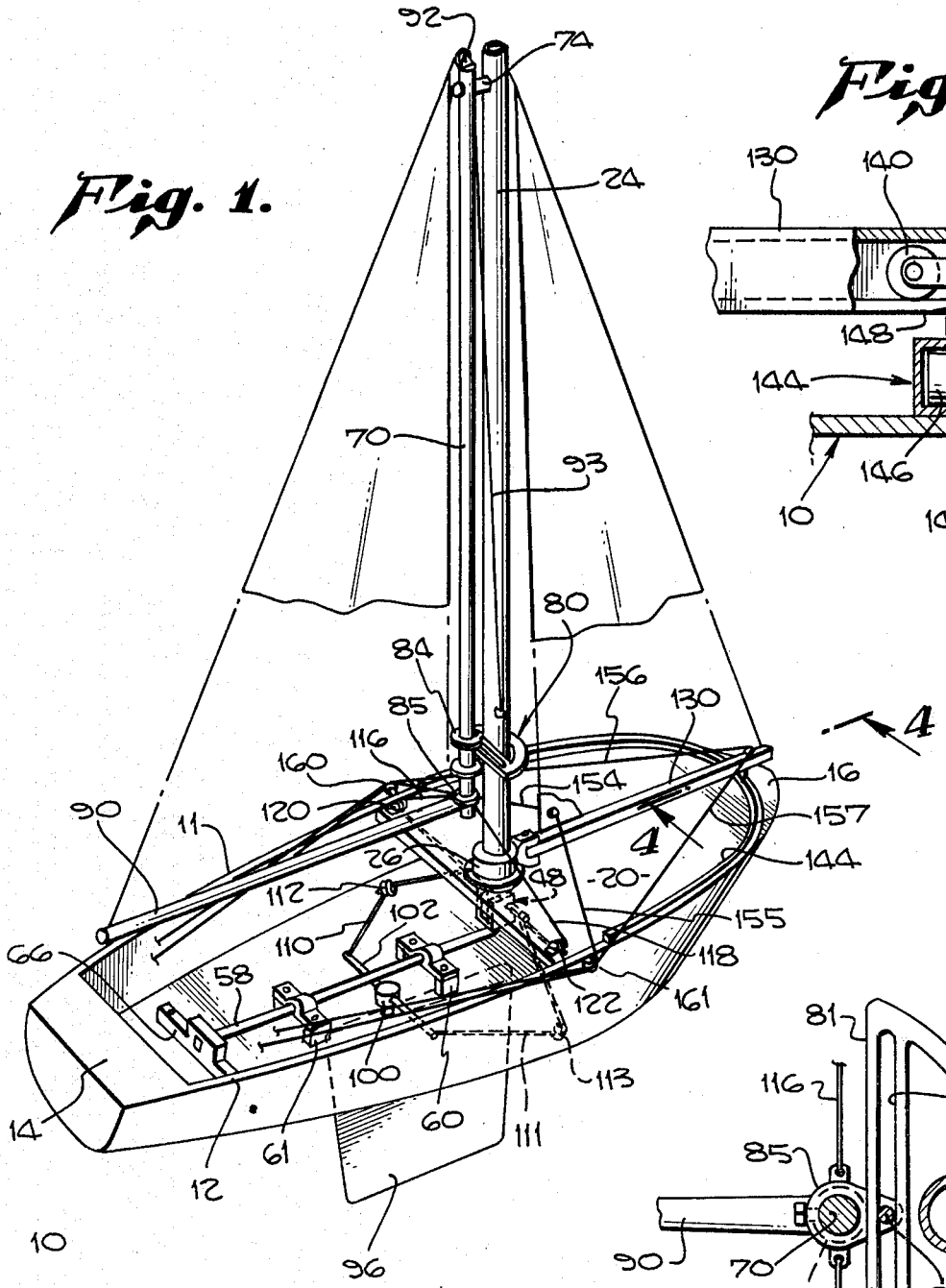
FIG. 1 is a pictorial view of a sailboat rigged with an exemplary form of the invention.

DESCRIPTION OF THE PREFERRED EMBODIMENT AND BEST MODE OF PRACTICING THE INVENTION

Referring to the drawings, numeral 10 designates the sailboat hull which may be of generally conventional construction. The gunwales are designated at 11 and 12, the stern at 14 and the bow at 16.

The boat has a foredeck designated generally at 20. The boat may have a typical steering mechanism not shown which may include a tiller or wheel and a rudder in a position for the helmsman to steer. Numeral 21 designates a bulkhead and numeral 23 designates a thwart.

Figure 2:
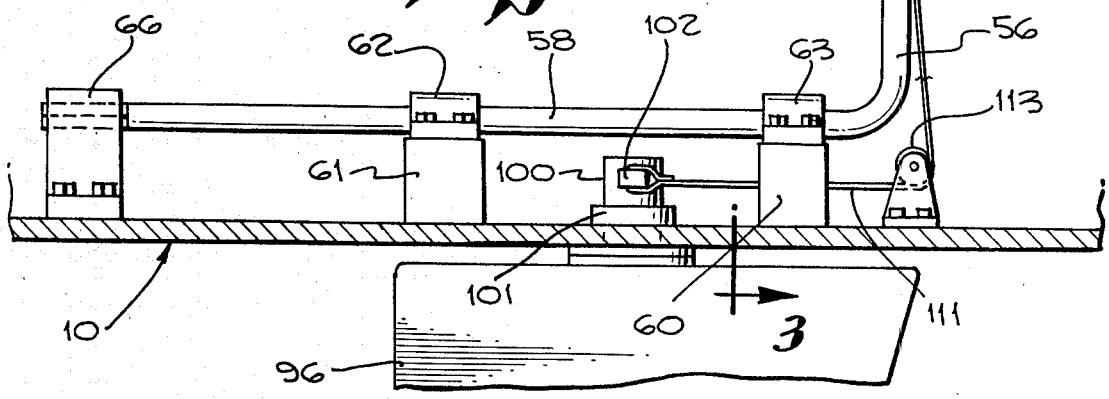
FIG. 2 is an enlarged view partly in section of the mast and torsion bar assembly of FIG. 1.

The boat has a primary mast as designated at 24. The mast is carried by a deck fitting or a block as shown at 26 in FIG. 2. The deck fitting is bolted to the deck 20 as shown. A ball and socket joint is provided so that the mast can tilt to port or starboard. This joint includes a ball 30 formed in the mast which is inside of a socket 32 formed within the deck fitting 26.

Figure 3:
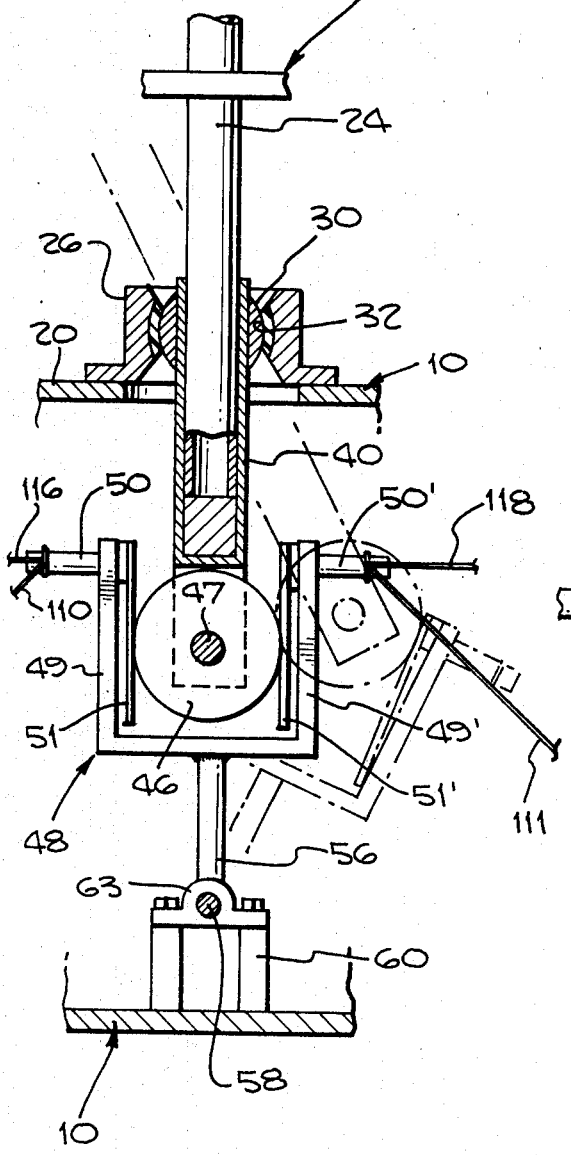
FIG. 3 is a sectional view taken along the line 3—3 of FIG. 2.
Figure 3:
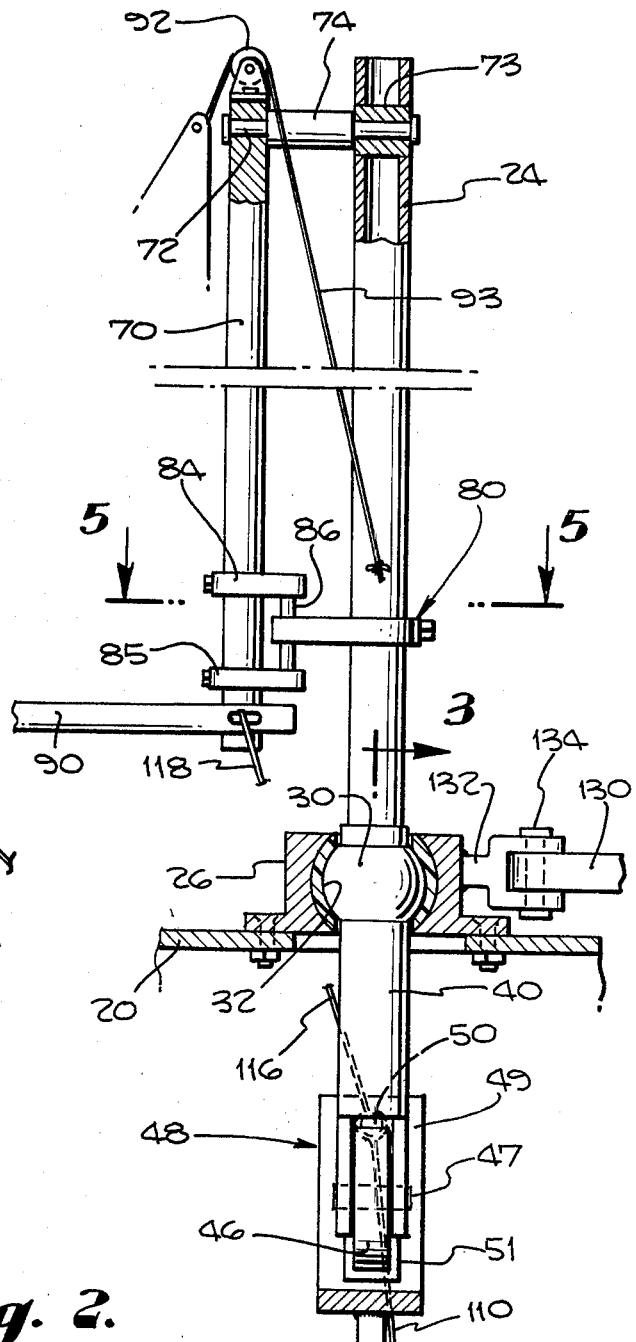

The lower end of the mast 24 is telescoped into a tubular member of fitting 40. (See FIG. 3) At the lower end of the member 40 there is provided a yoke or clevis between the legs of which there is journaled a roller or wheel 46 on a shaft or stem 47. This roller or wheel cooperates with a yoke 48 having legs 49 and 49'. The legs 49 and 49' have extending members 50 and 50' which will be referred to again presently. Mounted on the inside of the legs 49 and 49' are leaf springs 51 and 51' mounted at their upper ends. The wheel 46 bears against the leaf springs and when the mast tilts by way of pressure on one or the other of the leaf springs, the yoke 48 can be tilted one way or another. The yoke has a stem 56 on its underside which is connected to a torsion bar 58, the stem 56 being a right angle portion at the end of the torsion bar.

Numerals 60 and 61 designate support members supported from the hull of the boat as may be seen in more detail in FIG. 1, the torsion bar 58 being supported from these members and being held by bearings 62 and 63. The torsion bar twists and is anchored at the "T" (66). The torsion bar 58 lies amidships along the center line of the craft. The aft end of the bar 58 is journaled in a block 66, the end parts of which are bolted to the bottom of the boat, that is, the hull. As will be understood, when the mast 24 tilts to port or starboard under the effect of the wind, the yoke 48 is acted on to rotate it or tilt it in the opposite direction, producing torsion in the torsion bar 58 and producing a force which acts on the mast and on the hull to restore the mast and opposite to the direction of tilting of the mast and thereby to provide a trimming effect to maintain the hull in a level attitude. The torsion or twisting in torsion bar 58 acts on block 66 to produce the righting moment on the hull to restore it to a level or trimmed position.

Numeral 70 designates an auxiliary mast that is suspended like a pendulum from the top of the primary mast 24. It is carried on a pin 72 that extends through the masts and through a bushing 73 and the primary mast 24, and numeral 74 designating a spacer in between the two masts.

Figure 5:
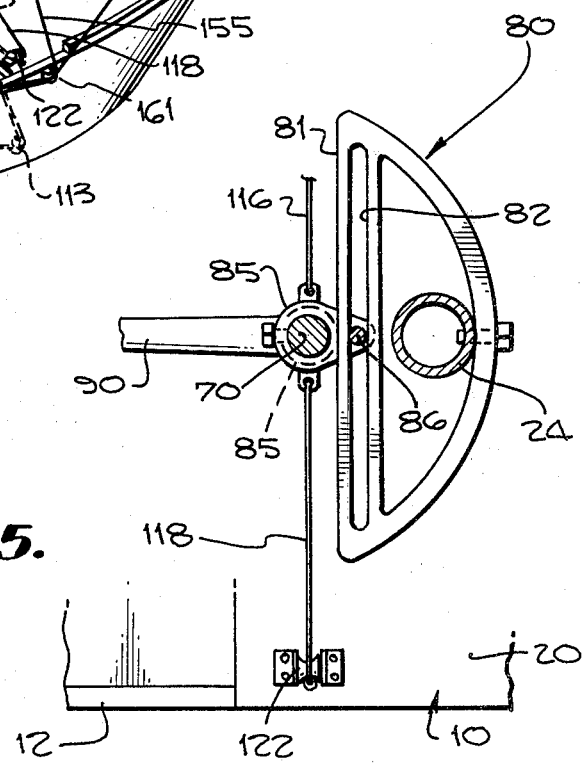
FIG. 5 is a sectional view taken along the line 5—5 of FIG. 2.

The lower end of the auxiliary mast 70 can swing to port or starboard. Numeral 80 designates a fitting carried by primary mast 24 as shown in FIG. 5. It is of arcuate shape as shown having a flat side 81, but in this side is a transverse or lateral slot 82. Carried on the auxiliary mast 70 are spaced adjustable disc members 84 and 85 (see FIG. 2) and extending between them is a pin 86 which is carried in the slot 82 as may be seen in FIG. 5. The primary mast 24 is connected to the auxiliary mast 70 so that when the primary mast tilts to port or starboard the auxiliary mast is similarly shifted as will be described presently.

Numeral 90 designates the main boom, the mainsail being shown in outline. At the top of the auxiliary mast is a pulley block carrying a pulley as designated at 92, the main halyard being designated at 93 for hoisting the mainsail.

Numeral 96 designates an adjustable, that is, rotatable keel. The configuration of the keel may conform generally to keels as known in the art. However, it is mounted on a stem 100 (FIG. 2) journaled in a bearing 101 so that the keel can be angularly rotated. Numeral 102 (FIG. 1) designates a cross bar extending laterally with respect to the stem 100.

The yoke 48 is connected by cables both to the auxiliary mast 70 and to the rotatable keel 96 so that when the primary mast tilts, the auxiliary mast is shifted and the rotatable keel is shifted for purposes that have been referred to in the foregoing. Numerals 110 and 111 designate cables which are attached to the arms 50 and 50' on the yoke 48. These cables pass over pulleys 112 and 113 and connect to the ends of the cross arm 102 so that whenever the yoke 48 is tilted to port or starboard, the keel 96 is rotated to have a compensating effect to offset the tendency of the hull to make a headway to leeward.

Numerals 116 and 118 designate cables also connected to the yoke 48 as shown which pass over pulleys 120 and 122 and which then are connected to the yoke 48 as shown. Thus, when the yoke 48 is tilted to port or starboard, forces are provided in the cables that cause the lower end of the auxiliary mast 70 to be swung to port or starboard to keep it in an upright attitude to preserve the effectiveness of the mainsail. The mainsail may be manipulated by main sheets as already shown in the prior art.

In addition to shifting of the auxiliary mast and mainsail when the primary mast 24 is shifted, the jib sail similarly is shifted to maintain it in a more effective attitude or aspect. For this purpose there is provided a jib boom 130 the after end of which is pivotally carried in a clevis fitting 132 attached to the deck fitting 26, the inner end of the jib boom being pivoted on a pin 134. See FIG. 2.

Figure 4:
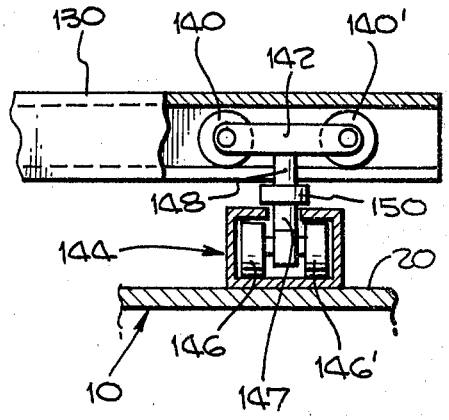
FIG. 4 is a sectional view taken along the line 4—4 of FIG. 1.

The forward end of the jib boom 130 is guided around the arcuate forward part of the hull and deck. As shown in FIG. 4, the boom 130 is hollow. Its interior forms a track for a pair of rollers 140 and 140' connected by a link 142. Formed on the deck 20 is an arcuate track 144 which guides movement of a pair of rollers 146 and 146' on a shaft 147. Numeral 148 designates a stem extending from the link 142 and in which the shaft 147 is journaled numeral 150 designating a guide member over track 144.

As may be seen, the jib boom 130 can be swung to port or starboard being accurately guided by the mechanism shown in FIG. 4. Jib sheets or lines are provided for adjusting the lower lefthand corner of the jib sail as designated at 154 and 155. Additional jib sheets 156 and 157 are provided for adjusting the forward end of the jib boom 130. The jib sheets pass back to a position where they can be manipulated by the helmsman passing over pulleys 160 and 161. By way of the means just described when the mast tilts and the auxiliary mast moves to port or starboard, the jib sail can be shifted to bring it into alignment with the mainsail, that is, in a funnel position.

From the foregoing, those skilled in the art will be readily able to understand the invention, the manner in which it operates, and the manner in which the parts are maneuvered in order to achieve the results intended.

Illustratively, when on one tack or the other or when changing, the force of the wind will cause the mast to tilt to leeward. When this happens, the yoke 48 is shifted as described which through the cables shifts the lower end of the auxiliary mast in the direction of tilt, so that it is kept generally upright with a favorable attitude or aspect with respect to the wind to avoid spilling. At the same time, the jib sail is similarly shifted by the helmsman to keep it aligned with the mainsail.

Also, torsion is applied to torsion bar 58 which tends to restore the mast to its upright position and to provide the righting or trimming moment or force for the hull.

When the mast tilts, additionally by reason of its connections to the keel 96, the keel is turned similarly to present a surface which will compensate in a manner to offset the tendency of the hull to make headway to leeward.

Figure 6:
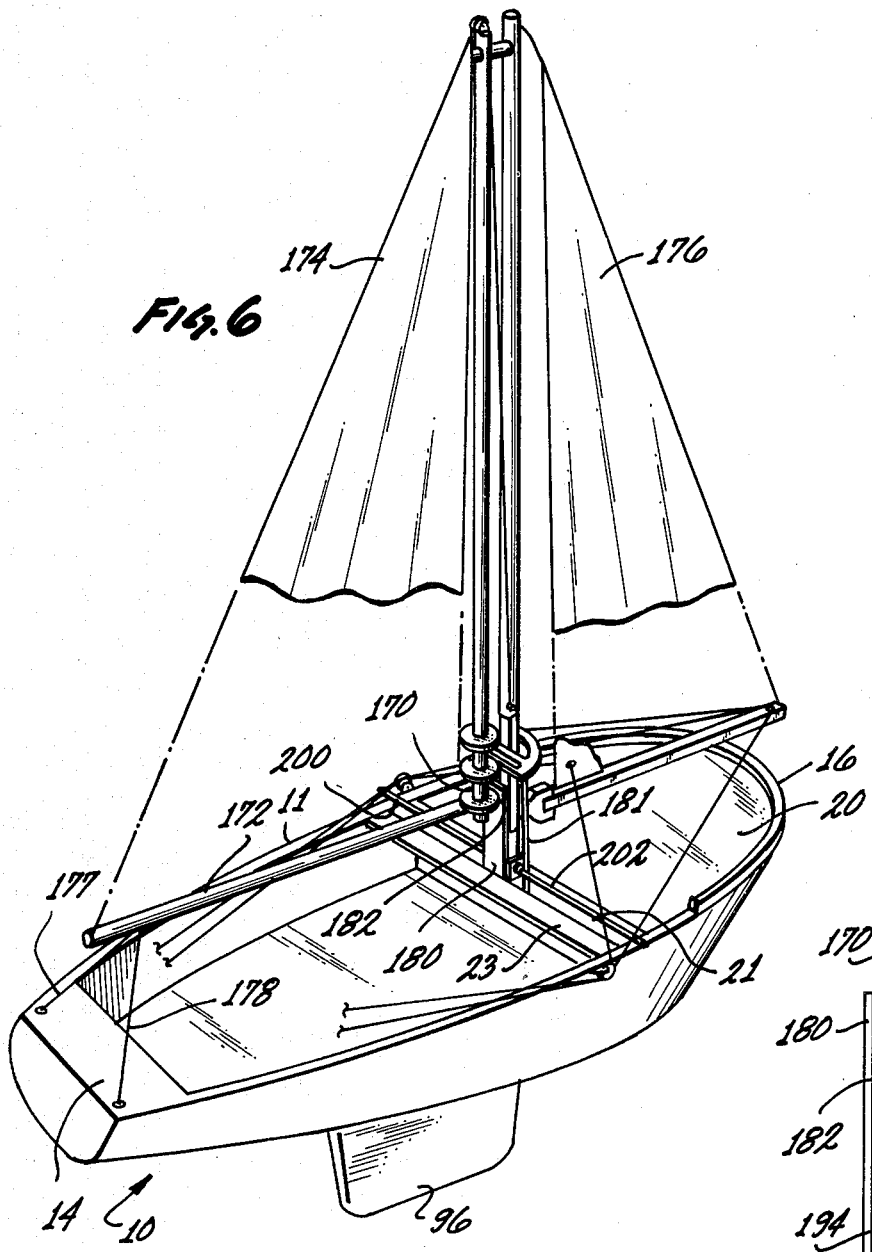
FIG. 6 is a pictorial view of a sailboat rigged with a modified form of the invention.
Figure 8:
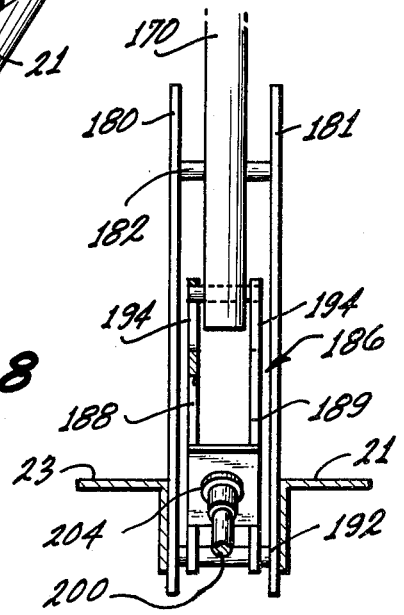
FIG. 8 is a sectional view taken along the line 8—8 of FIG. 7.
Figure 7:
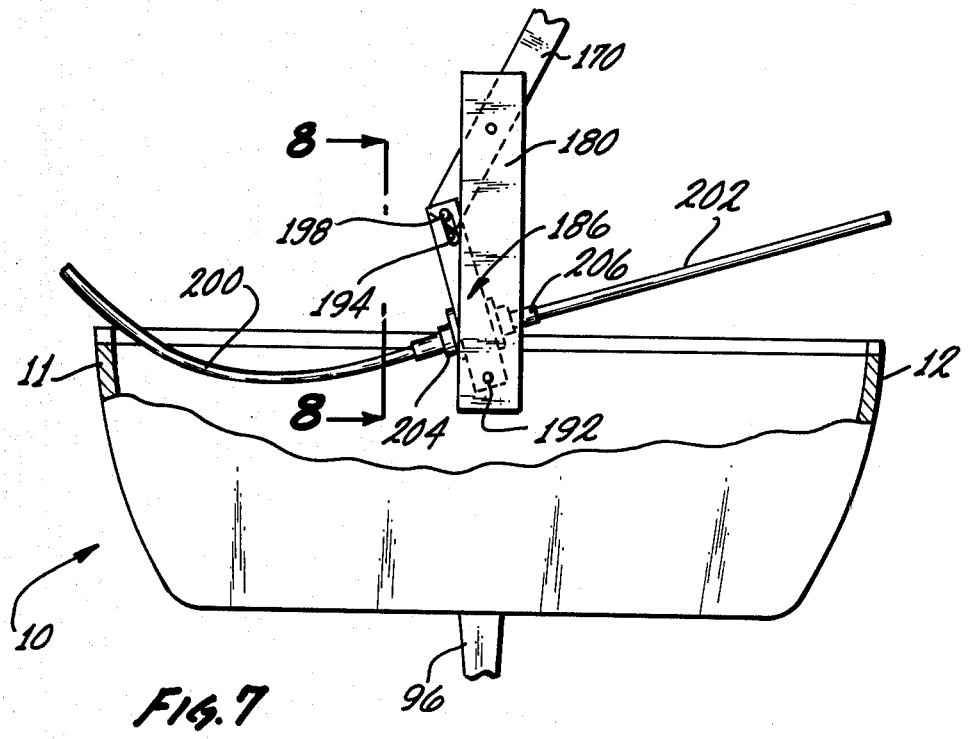
FIG. 7 is a schematic cross-sectional view of the form of the invention of FIG. 6 illustrating its operation.

FIGS. 6, 7, and 8 illustrate schematically a modified form of the invention. The hull of the craft is like that of the previous embodiment and is identified by similar reference characters. In this form of the invention the craft is provided with a mast as designated at 170 having a boom 172 and a triangular sail 174. Numerals 177 and 178 designate lines for controlling the boom.

Numerals 180 and 181 designate a pair of upright members supported from the bottom of the boat. The lower part of the mast is pivotally mounted between these members by a pivot member or shaft as designated at 182. Numeral 186 designates a yoke assembly which has side members 188 and 189 which are pivotally mounted on a cross pin or shaft 192 extending between the side members 180 and 181. At the upper ends of these members they are slotted as indicated at 194 in FIG. 7. At the end of the mast 170 below the pivot or shaft member 182 is a cross pin 198 which moves in the slots as shown in 194 and the members 188 and 189.

Attached to the assembly 186 are flexible members 200 and 202 which are resilient rods made of metal or comparable material. The inner end of the rod 200 is secured to the assembly 186 by way of a fitting shown at 204, the rod 202 being attached by a similar fitting 206.

When the mast is upright, the rods 200 and 202 extend to port and starboard as shown and merely rest on the sides of the gunwales 11 and 12 of the craft. In other types of craft a frame member can be provided to be engaged by these rods.

The operation of this embodiment corresponds to that of the previous embodiment. FIG. 7 shows the mast tilted to starboard, that is, to leeward with the yoke assembly 186 tilted the other way. In this position the rod 200 is flexed as shown in FIG. 7, producing a force tending to return the yoke assembly 186 to an upright position and to return the mast 170 to an upright position. In this configuration, the hull would, of course, be tilting or listing to starboard so that the tension in the rod 200 acting on the port side of the boat, that is, on the gunwhale 11 would exert a force or a moment tending to return the hull to a level trimmed position.

Figure 9:
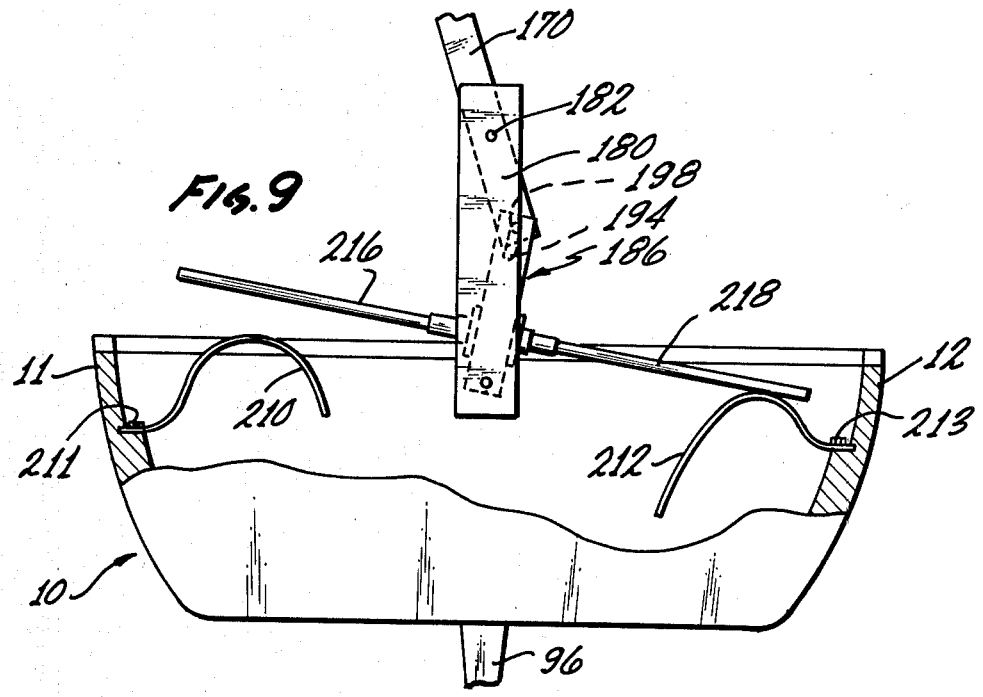
FIG. 9 is a schematic view of a further modified form of the invention.

FIG. 9 shows another alternative form of the invention. Corresponding parts in this figure are identified by the same reference characters as in previous embodiments. In FIG. 9, numeral 210 designates a flexible spring member of bowed shape as shown, one end of which is secured to the inside of the hull of the boat as shown at 211. A similar spring as identified at 212 is secured to the hull on the other side of the boat as shown at 213.

Attached to the assembly 186 is a rigid bar member 216 extending to the left or to port and secured to the other side of the assembly 186 is another rigid bar member 218 extending to starboard.

FIG. 9 shows a configuration in which the mast 170 is tilted to port so that the assembly 186 is tilted to starboard with the rigid members 216 and 218 in the position shown. In this position the member 218 engages the spring 212 bending it downwardly as shown and placing tension in it producing a force tending to return the assembly 186 to an upright position and the mast 170 to an upright position. Additionally, the coaction between member 218 and the spring 212 produces a downward force on the starboard side of the craft thereby producing a righting moment tending to return the craft to level or trimmed position, the craft tending to list to port when the mast 170 is in a position as shown in FIG. 9. Thus it can be seen that the form of the invention as shown in FIG. 9 operates similarly to that of the previous embodiments.

From the foregoing, the manner in which the objectives as set forth in the foregoing are realized will be readily understood.

It is to be understood that certain features of the invention may be adapted and utilized without utilizing other features. That is, the application of the torsion to the bar 58 to provide a righting moment when the mast tilts, may be utilized without shifting of the sails. Similarly, the keel could be shifted or adjusted in response to tilting of the mast without utilizing the capability of applying a righting moment to the hull or adjusting the sails.

The foregoing disclosure is representative of a preferred form of the invention and is to be interpreted in an illustrative rather than a limiting sense, the invention to be accorded the full scope of the claims appended hereto.

What is claimed is:

1. In a sailboat having a hull and a mainsail means for maintaining leveling or trimming of the hull comprising in combination, a mast mounted to be capable of tilting to port or starboard under the influence of the wind, means operatively connected to the mast to apply a force resisting the tilting of the mast, said means including a torsion bar mounted along the center line of the hull and connected to the mast whereby tilting of the mast applies torsion to one end of the bar about the axis of the torsion bar providing a righting moment and restoring force, the torsion bar having an end part connected to the boat whereby the torsion in the bar exerts a righting moment on the hull.

2. Apparatus as in claim 1 including an auxiliary mast supported from the first mentioned mast in a position for its lower end to move to port or starboard, and means whereby when the first mast tilts, the lower part of the auxiliary mast is moved in the same direction, whereby to keep the mainsail in an upright position.

3. Apparatus as in claim 2, including an adjustable keel, mounted to be adjustable for compensating for tendencies of the hull to make headway to leeward, and means providing connections between the keel and the mast whereby when the mast is tilted, the keel is adjusted to compensate, by being rotated about a vertical axis.

4. In a sailboat, having a hull and a mainsail, means for maintaining leveling or trimming of the hull comprising in combination, a mast mounted to be capable of tilting to port or starboard under the influence of the wind, means operatively connected to the mast to apply a force resisting the tilting of the mast, said means including a torsion bar mounted along the center line of the hull and connected to the mast whereby tilting of the mast applies torsion about the axis of the torsion bar providing the righting moment resisting and restoring force, the torsion bar including an upright member and an end part connected to the boat, a yoke carried by the upright member and means at the end of the mast cooperating with the yoke member for shifting it oppositely to the direction of tilt of the mast.

5. In a sailboat, means for providing leveling or trimming of the hull comprising in combination, a mast mounted to be capable of tilting to port or starboard under the influence of the wind, means operatively connected to the mast to apply a force restoring the mast to upright position, means comprising an adjustable keel mounted to be adjustable about a vertical axis to compensate for tendencies of the hull to make headway to leeward and means providing connections between the keel and the mast whereby when the mast is tilted the keel is adjusted about the vertical axis to compensate.

6. In a sailboat, having a hull and a mainsail, means for providing leveling or trimming of the hull comprising in combination, a mast mounted to be capable of tilting to port or starboard under the influence of the wind, an auxiliary mast supported from the first mentioned mast in a position for its lower end to move port or starboard, and means whereby when the first mast tilts, the lower part of the auxiliary mast moves in the same direction, whereby to keep the mainsail in an upright position, means providing an adjustable keel for compensating for tendencies of the hull to make headway to leeward, and means providing connections between the keel and the mast whereby when the mast is tilted the keel is adjusted.

7. In a sailboat having a hull and mainsail, means for maintaining leveling or trimming of the hull comprising in combination, a mast mounted to be capable of tilting to port or starboard under the influence of the wind, means operatively connected to the mast to apply a force resisting the tilting of the mast, means including an auxiliary mast supported from the first mentioned mast in a position for its lower end to move to port or starboard, means whereby when the first mast tilts, the lower part of the auxiliary mast moves in the same direction, whereby to keep the mainsail in an upright position, means providing an adjustable keel rotatable angularly about a vertical axis for compensating for tendencies of the hull to make headway to leeward, and means providing connections between the keel and the mast whereby when the mast is tilted the keel is adjusted to compensate.

8. A sailboat as in claim 7 including means including a jib sail and jib boom, means whereby the forward end of the jib boom can be swung to port or starboard and sheet means whereby the lower aft corner of the jib sail and the forward end of the jib boom can be shifted for aligning the jib sail with the mainsail.

9. In a sailboat having a hull and a mainsail, means for maintaining leveling or trimming of the hull comprising in combination, a mast mounted to be capable of tilting to port or starboard under the influence of the wind, means operatively connected to the mast to apply a force resisting the tilting of the mast, said means including mechanism positioned to be actuated by tilting of the mast to produce a force for returning the mast to an upright position and simultaneously for producing a force applying a righting force to the hull, said mechanism having a part engagable with the mast, the part being rotatably mounted and means actuated by the part rigidly affixed to and positioned to directly act on the hull.

10. In a sailboat having a hull and main sail, means for maintaining leveling or trimming of the hull comprising in combination, a mast mounted to be capable of tilting to port or starboard under the influence of the wind, means operatively connected to the mast to apply a force resisting the tilting of the mast, said means including means positioned to be actuated by tilting of the mast to produce a force for returning the mast to an upright position and simultaneously for producing a force applying a righting force to the hull, comprising a movable yoke positioned to engage the lower end of the mast and movable to port and starboard, and means operative by the yoke to produce a force for restoring the mast to upright position and for producing a righting moment acting on the hull.

11. An apparatus as in claim 10 including resilient members extending between the said yoke and the sides of the boat whereby when the end of the mast moves to one side the resilient member on that side is flexed and put under tension producing the said forces.

12. An apparatus as in claim 11 wherein said means includes a spring member at each side of the lower end of the mast, and means actuatable by the mast engagable with the said spring members whereby when the lower end of the mast moves to one side of said elements acts on a spring member to produce tension in it and a restoring force.

* * * * *